US006183117B1

(12) United States Patent
Bucher et al.

(10) Patent No.: US 6,183,117 B1
(45) Date of Patent: Feb. 6, 2001

(54) SPRING CLIP LIGHT FIXTURE CONNECTOR

(75) Inventors: Charles E. Bucher, Valrico; John C. Bucher, Ft. Lauderdale, both of FL (US)

(73) Assignee: King of Fans, Inc., Ft. Lauderdale, FL (US)

( * ) Notice: Under 35 U.S.C. 154(b), the term of this patent shall be extended for 0 days.

(21) Appl. No.: 09/361,376

(22) Filed: Jul. 27, 1999

Related U.S. Application Data

(62) Division of application No. 08/861,946, filed on May 24, 1997, now Pat. No. 5,971,573.

(51) Int. Cl.[7] ..... F21V 17/06
(52) U.S. Cl. ..... 362/438; 362/433
(58) Field of Search ..... 362/96, 363, 404, 362/405, 438, 454, 453, 433

(56) References Cited

U.S. PATENT DOCUMENTS

| | | | |
|---|---|---|---|
| D. 259,060 | 4/1981 | Hansen | D26/59 |
| D. 303,435 | 9/1989 | Mason | D26/72 |
| D. 311,247 | 10/1990 | Sonneman | D23/377 |
| D. 315,946 | 4/1991 | Hollbrook | D23/377 |
| 1,714,110 | 5/1929 | Sprecher | 362/438 |
| 1,792,260 | 2/1931 | Werner | 362/438 |
| 2,731,547 | 1/1956 | Callard | 240/81 |
| 3,070,690 | 12/1962 | Horn | 240/131 |
| 4,327,403 | 4/1982 | Capostagno | 362/306 |
| 4,428,032 | 1/1984 | Workman | 362/96 |
| 4,531,179 | 7/1985 | Baker | 362/371 |
| 4,626,970 | 12/1986 | Huang | 362/147 |
| 4,764,855 | 8/1988 | Fretz et al. | 362/433 |
| 4,982,313 | 1/1991 | Lupien | 362/368 |
| 4,998,193 | 3/1991 | Chuing-Hui | 362/414 |
| 5,088,670 | 2/1992 | Taylor | 248/225.1 |
| 5,122,942 | 6/1992 | Lee | 362/353 |
| 5,349,510 | 9/1994 | Jordan et al. | 362/374 |
| 5,971,573 * | 10/1999 | Bucher et al. | 362/438 |

* cited by examiner

*Primary Examiner*—Stephen Husar
(74) *Attorney, Agent, or Firm*—Brian S. Steinberger; Law Offices of Brian S. Steinberger

(57) ABSTRACT

Spring clips for holding lamp shades such as but not limited to fragile globe and funnel shapes, onto lamp fixtures include elongated types clips that connect to the stem beneath the socket of the lamp fixture. The longitudinal clips springably expand within the neck and lower interior expanding portion of the globe shade, securely holding the latter in place to the lamp fixture. The spring clips have great applicability to the light fixtures on ceiling fans offering a secure fastening system that prevents accidental dislodging of the fragile shade when vibrations from the spinning fan occur. The spring clips allow the shades to be more easily put in place over the overhead type light fixtures as compared to the traditional method of using side screws to support and secure the shades. The clips can have hook or barb ends which prevent the accidental release of the shade from the fixture. A safety sleeve can be included which slips over the socket so that the sleeve and the clip together help prevent the shades from being accidentally dislodged from the socket.

8 Claims, 14 Drawing Sheets

SPRING CLIP LIGHT FIXTURE CONNECTOR

This is a Divisional of application Ser. No. 08/861,946 filed May 24, 1997, now U.S. Pat. No. 5,971,573.

This invention relates to light fixtures, and in particular to longitudinal spring clips for securing lamp shades to light fixtures.

BACKGROUND AND PRIOR ART

The traditional means for securing a lamp shade to a light fixture is usually a plurality of screws spaced around the rim of the receptacle that are tightened to engage in a recess within the neck of the lamp shade. See for example U.S. Pat. No. Des. 259,060 to Hansen; U.S. Pat. No. Des. 303,435 to Mason; U.S. Pat. No. Des. 311,247 to Sonneman; U.S. Pat. No. Des. 315,946 to Hollbrook; U.S. Pat. No. 4,531,179 to Baker; and U.S. Pat. No. 4,764,855 to Fretz, III et al.

While these screws serve the purpose of attaching the lamp shade to the fixture, using the screws presents numerous problems. Manipulating these small attachment screws can be difficult by itself and is worsened by the location of the light fixture which is usually secured to a ceiling location. Furthermore, when the fixture is attached to a vibrating structure, such as a ceiling fan, the screws can loosen, causing the shade to create a vibrating noise or even worse, resulting in the shade fixture falling from the fixture Still furthermore, the unsightly appearance of the screws detracts from the light fixtures overall appearance.

Other types of lamp shade fasteners have relied on retaining collars in the shades which generally screwably attach the bases of the shades to the sockets. See for example U.S. Pat. No. 3,070,690 to Horn; U.S. Pat. No. 4,998,193 to Ching-Hui; and U.S. Pat. No. 5,122,942 to Lee. These types of fasteners also have similar problems to the side screws described above. They can be difficult to install and may loosen in a vibrating environment.

Other attempts have focussed on using side slots in the base of the shade that must be aligned to protruding prongs on the socket See for example: U.S. Pat. No. 4,982,313 to Lupien which shows additional problems of manipulating the prongs to the slots on an overhead fixture, where vibrations can also dislodge the prongs from the slots. Additionally, this fastener requires the lamp shade to be of a unique shape and is not adaptable to the existing lamp shade designs.

A resilient clip was disclosed in U.S. Pat. No. 4,428,032 to Workman which claims to adequately secure a shade to an overhead light fixture. However, the Workman clip requires four extending prongs which must grip about the exterior of the base rim of the lamp shade. The Worknan clip would not work with all the different lamp shades made by various manufacturers since there exists a relatively large deviation in the size and shape of the rims in those different lamp shades. Because there is limited movement of the prongs in the Workman clip, it would be difficult to insure a secure fit for the majority of these lamp shades. Furthermore, manipulating the lamp shade base adequately to fit within the space of the four prongs in an overhead fixture would not be easy, and it requires that an exterior canopy be fitted over the prongs to insure a secure fit and to prevent the accidental release of the lamp shade.

Thus, the need exists for a solution to the above presented problems with the prior art.

SUMMARY OF THE INVENTION

The first objective of the present invention is to provide a longitudinal spring clip for securing a shade to a lamp socket and a lamp fixture.

The second object of this invention is to provide a clip that is insertable into the base of a lamp shade to secure the shade to a lamp socket.

The third object of this invention is provide a clip for holding a lamp shade to a lamp socket and fixture that prevents the accidental release of the shade due to vibrations, someone accidentally hitting the fixture, earthquakes and the like.

A preferred embodiment of the spring clip connector is used for attaching a shade having an expanding portion and a narrow neck portion to a socket of a light fixture. The novel single longitudinal clip has a first concave bend between a midportion of the clip and one end, and a second concave bend between the midportion of the clip and an opposite end, wherein a midportion of the clip is located beneath the socket so that the ends of the clip insert within the shade neck and springably expand out into the interior of the expanded portion of the shade. The lamp shades can be fragile shades such as but not limited to global, funnel shapes and the like Preferably the first bend and the second bend in the clip are each approximately one hundred twenty degrees from the midportion of the clip.

Another embodiment of the novel spring clip is similar but with a through-hole in the mid-portion of the clip for allowing the protruding stem of the fixture to extend therethrough.

A still another embodiment includes a bent hook end with novel spring clip having the through-hole.

Another embodiment of the novel spring clip has a first coil spring adjacent to the first bend for forming a first leaf wing, and a second coil spring adjacent to the second bend for forming a second leaf wing, wherein the first spring and the second spring springably expand the first leaf wing and the second leaf wing outward within the neck and interior of the shade.

Another embodiment includes a bent tab portion adjacent one interior end of the novel spring clip. The tab has a horizontal base with a first raised portion approximately 45 degrees attached to the base, and a second raised portion tip approximately 75 degrees to the first raised portion, wherein the tab prevents accidental release of the shade.

A still another further embodiment includes a sleeve having a base for slipping over the socket, the sleeve and the longitudinal clip preventing accidental release of the shade from the socket.

Further objects and advantages of this invention will be apparent from the following detailed description of a presently preferred embodiment which is illustrated schematically in the accompanying drawings.

DESCRIPTION OF THE PREFERRED EMBODIMENT

Figure 1A:
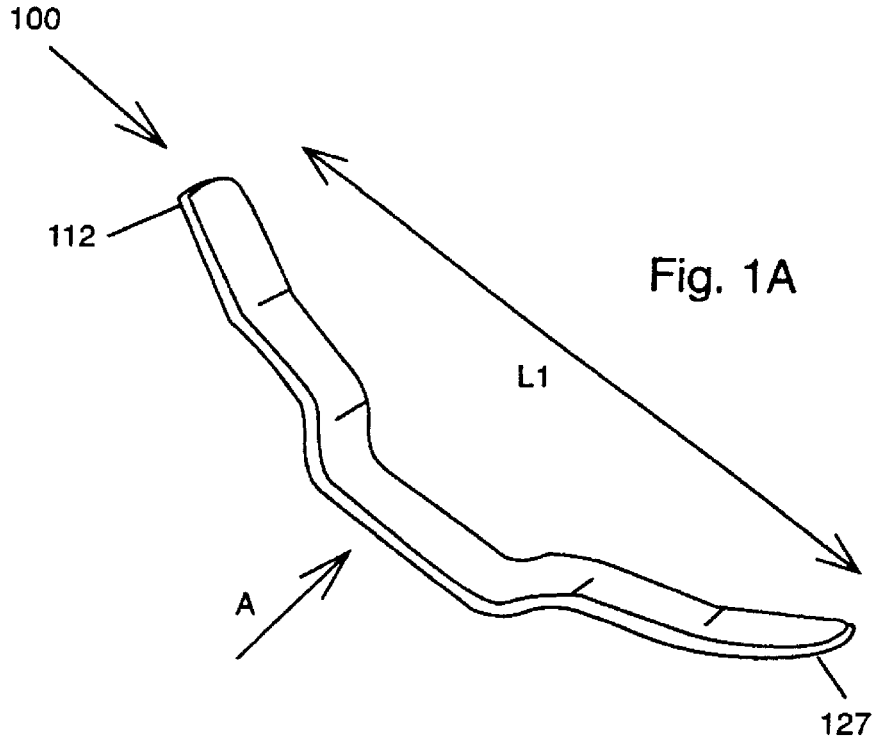
FIG. 1A is a perspective view of a first preferred embodiment of the novel spring clip.
Figure 1B:
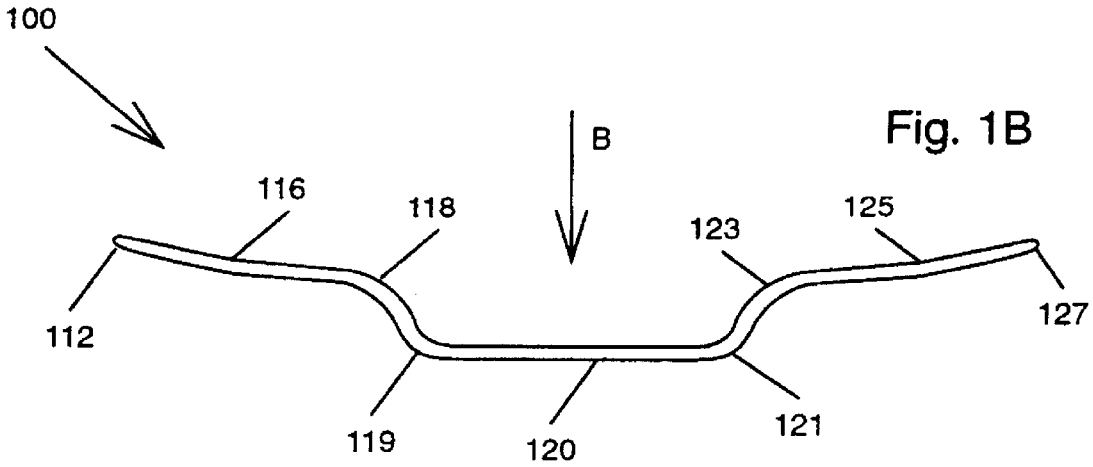
FIG. 1B is a side view of FIG. 1A along arrow A of the novel spring clip.
Figure 1C:
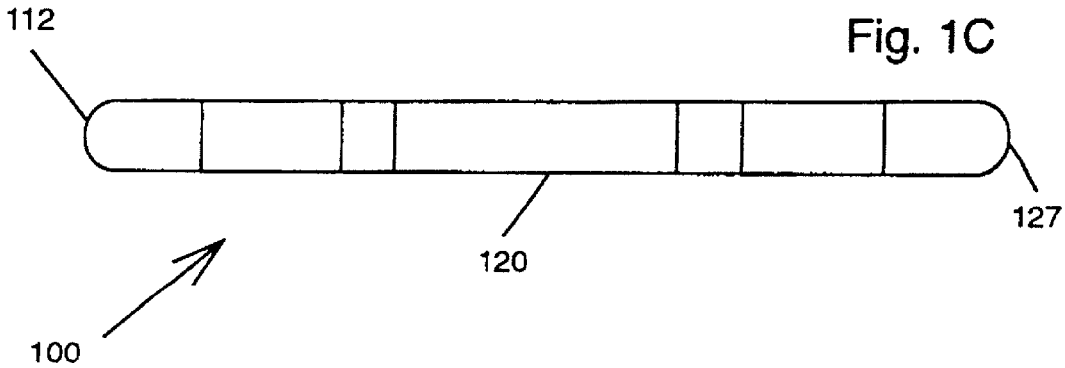
FIG. 1C is a top view of the novel spring clip of FIG. 1B along arrow B.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation FIG. 1A is a perspective view of a first preferred embodiment 100 of the novel spring clip. FIG. 1B is a side view of FIG. 1A along arrow A of the novel spring clip 100. FIG. 1C is a top view of the novel spring clip 100 of FIG. 1B along arrow B. Referring to FIGS. 1A–1C, novel spring clip 100 includes a longitudinal rectangular band having rounded ends 112 and 127 and a thickness of approximately of 0.015 inches. Longitudinal band 100 is preferably stamped from spring steel and formed to produce the shape shown in the Figures. Alternatively, other suitable materials with similar resistance can be used such as but not limited to steel, sinless steel, galvanized steel, brass, and the like.

Referring to FIGS. 1A–1C, spring clip 100 has a slight upward planar sloping end 112 from point 116 having a slight concave bend, a slightly downward angled portion between 116 and 118, and a downward angled convex bend of approximately 50 degrees at point 118. Clip 100 further includes a concave bend at 119 of approximately 120 degrees to the flat center portion between 119 and 121, and a mid-portion 120 between 119 and 121. At 121 there is a concave bend of approximately 120 degrees similar to bend 119. A slight convex bend of approximately 50 degrees at 123 gives way to a straight portion between 123 and 125, and a slight concave upward bend at 125 forms a tab end between 125 and 127.

Figure 2A:
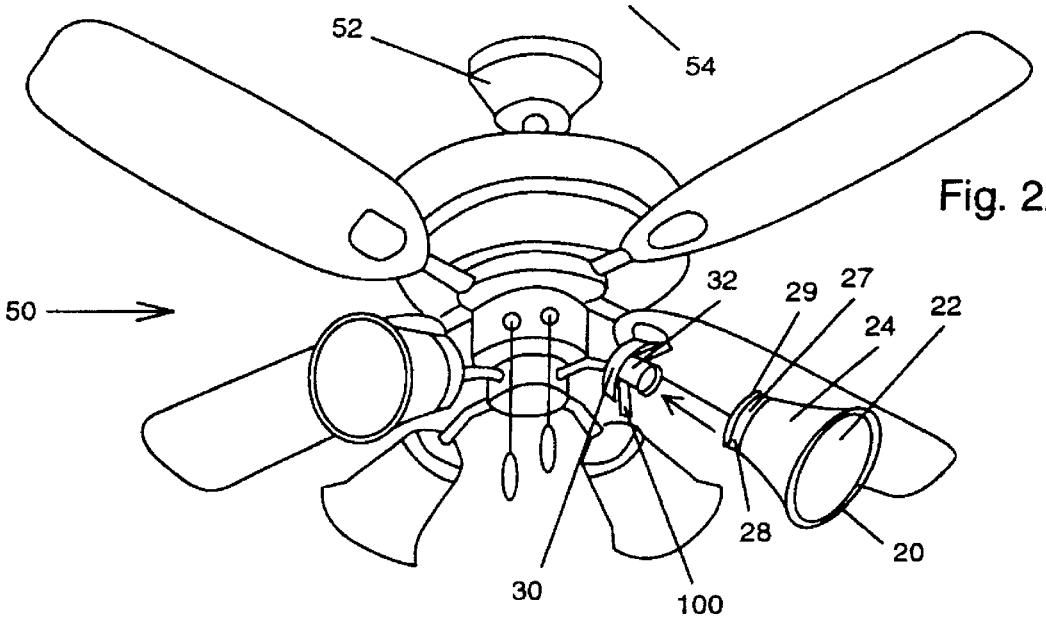
FIG. 2A is a perspective view of using the novel clip of FIG. 1A–1C to attach shades to lamp fixtures having sockets that are part of a ceiling fan.
Figure 2B:
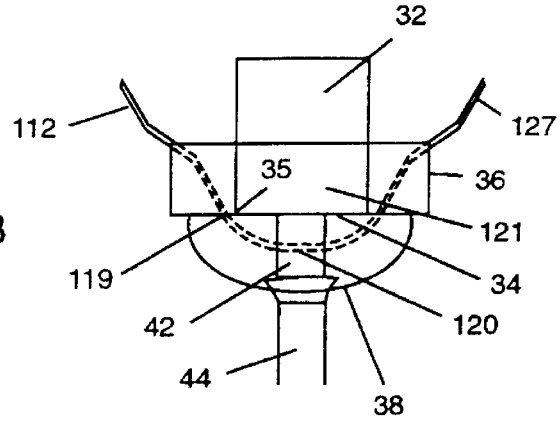
FIG. 2B is a side cross-sectional view of a single fixture of FIG. 2A and the spring clip of FIG. 1B.

FIG. 2A is a perspective view 50 of using the novel clip 100 of FIGS. 1A–1C to attach shade(s) 20 to lamp fixture(s) 30 having socket(s) 32 that are part of a ceiling fan attached to a ceiling 54 by a canopy 52. FIG. 2B is a side cross-sectional view of the fixture 30 of FIG. 2A using the spring clip 100 of FIG. 1B. Referring to FIGS. 2A–2B, shade 20 includes mouth opening end 22, rounded sidewalls 24, indented edge 27, narrow neck 28, and neck base rim 29. Lamp fixture 30 includes cylindrical socket 32 having interior threads(not shown) for holding a conventional light bulb(not shown). A cylindrical dome rim 36 with a rounded dome type canopy 38 is spaced apart and around about the socket 32. Beneath socket 32 is a socket mounting bracket 42 within the canopy 38 and a outer stem portion 44 exterior to the canopy 38 which is connected a mount structure such as a conventional type ceiling fan mount 50.

Figure 2C:
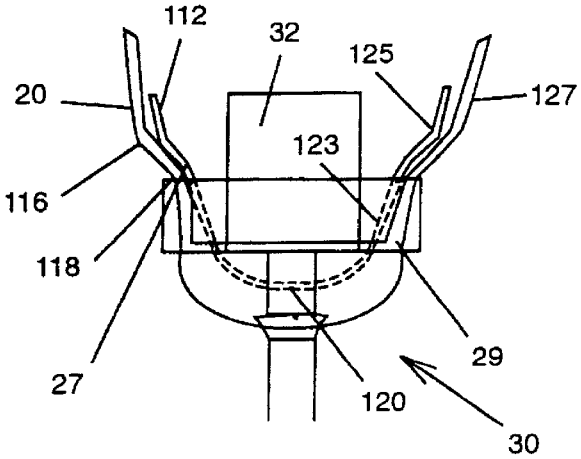
FIG. 2C is a view of FIG. 2B with a shade assembled and held in place to the fixture.

FIG. 2C is a view of FIG. 2B with the shade 20 of FIG. 2A held in place by the spring clip 100 to the fixture 30. Referring to FIGS. 2B and 2C, midportion 120 of clip 100 can can be generally positioned beneath the socket 32 so that points 119 and 121 of the clip are adjacent to outer bottom edges 35 of the socket 32. To mount the shade 20, tab ends 112 and 127 are depressed towards socket 32 so that the neck base rim 29 can fit over the tab ends 112 and 127. Next, the neck base rim 29 is inserted within the dome rim 36, so that the clip bend 118 abuts against the interior surface of indented edge 27 of shade 20, and that a mid portion between clip section 123–125 abuts against an opposite interior surface of indented edge 27 of shade 20. When fully mounted, the mid-portion between clip sections 123–125 and 116–118 springably expand to abut against opposite interior surfaces of shade 20, securely holding it to fixture 30.

Figure 3A:
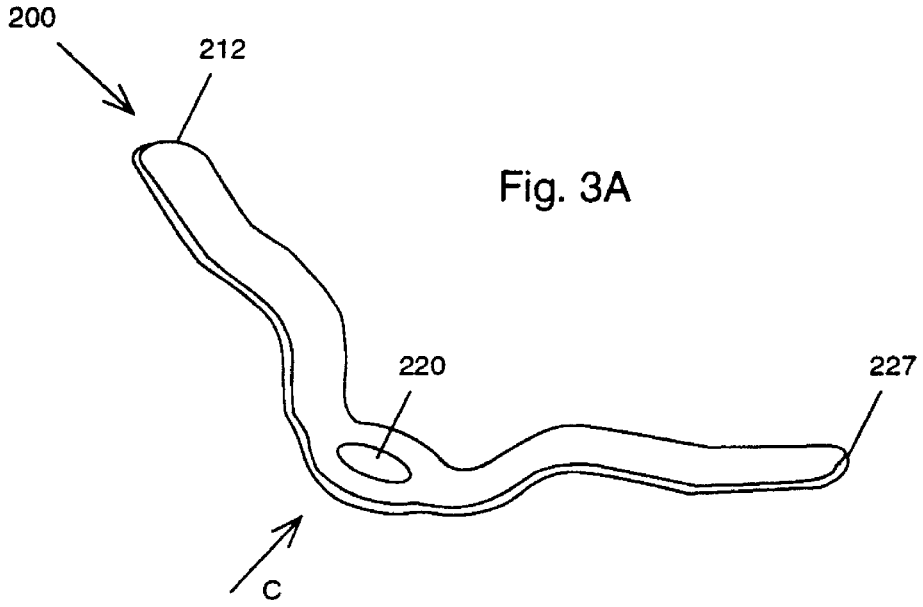
FIG. 3A is a perspective view of a second preferred embodiment of the novel spring clip.
Figure 3B:
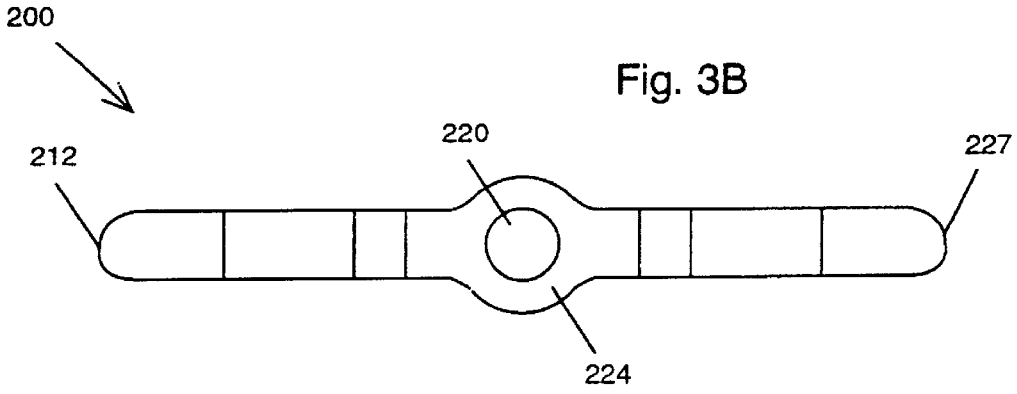
FIG. 3B is a top view of the spring clip of FIG. 3A.
Figure 3C:
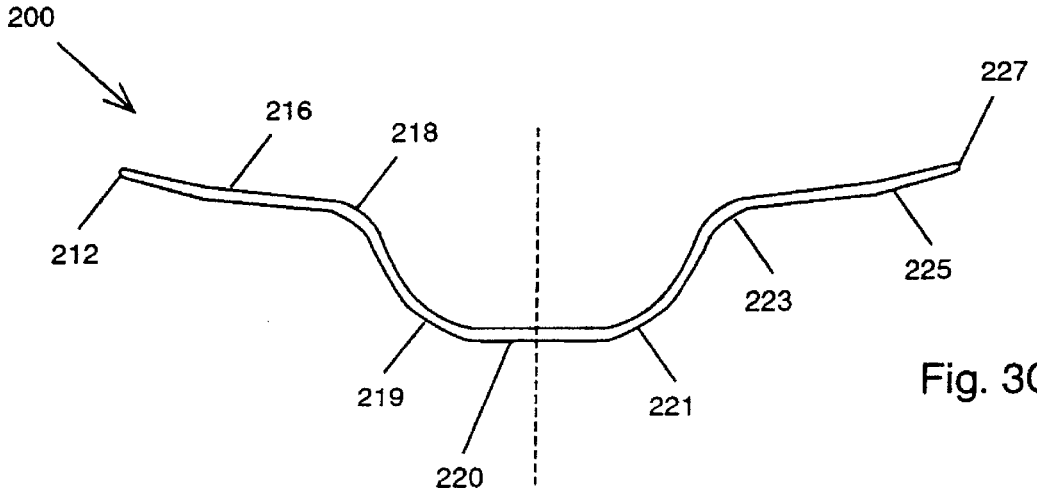
FIG. 3C is a side view of the spring clip of FIG. 3A along arrow C.

FIG. 3A is a perspective view of a second preferred embodiment 200 of the novel spring clip. FIG. 3B is a top view of the novel spring clip 200 of FIG. 3A. FIG. 3C is a side view of the novel spring clip 200 of FIG. 3A along arrow C.

Referring to FIGS. 3A–3C, spring clip 200 has a straight portion between points 214 and 216, the latter having a slight concave bend, and a slightly downward angled portion between 216 and 218. Spring clip 200 further includes a downward angled convex bend of approximately 50 degrees at point 218, a concave bend at 219 that is approximately 120 degrees to concave rounded center portion between 219 and 221. 220 refers to the mid-portion between 219 and 221. At 221 there is a concave upward bend of approximately 120 degrees similar to bend 219. A slight convex bend of approximately 50 degrees at 223 gives way to a straight portion between 223 and 225, and a slight concave upward bend at 225 forms a tab end between 225 and 227.

The main difference between embodiment 200 of FIGS. 3A–3D than the previous embodiment is a center-through hole 230 in the midportion 222 that allows for stem 44 of the lamp fixture 30(of FIGS. 2A–2C) to pass therethrough and be fixed under socket mounting bracket 42.

Midportion area 220 has an enlarged width portion 234 in the clip 200 about the center through-hole 230. The rest of embodiment 200 is used similarly to that of the previous embodiment described above.

Figure 4A:
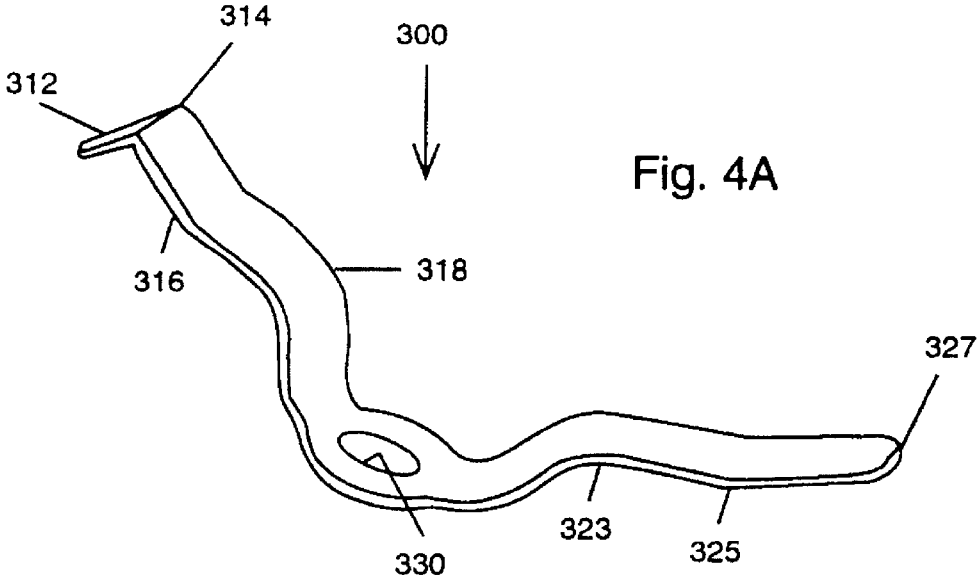
FIG. 4A is a perspective view of a third preferred embodiment of the novel spring clip.
Figure 4B:
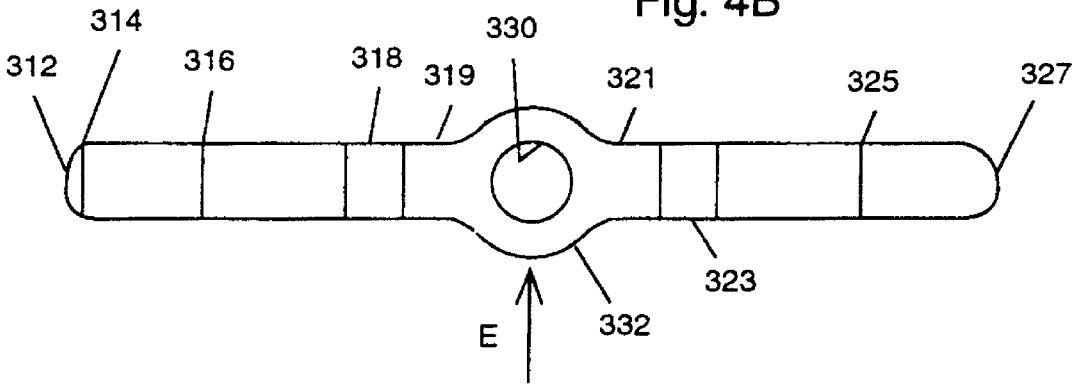
FIG. 4B is a top view of the spring clip of FIG. 4A.
Figure 4C:
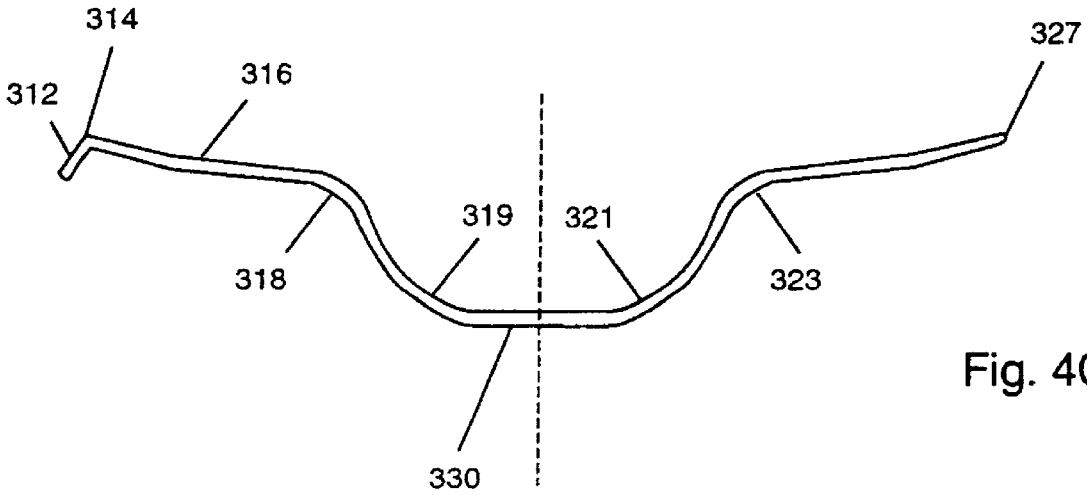
FIG. 4C is a side view of the spring clip of FIG. 4B along arrow E.

FIG. 4A is a perspective view of a third preferred embodiment 300 of the novel spring clip. FIG. 4B is a top view of the spring clip 300 of FIG. 4A. FIG. 4C is a side view of the spring clip 300 of FIG. 4B along arrow E. Referring to FIGS. 4A–4C, spring clip 300 has a downward approximately 90 degree angled hook end 312, a straight portion between points 314 and 316, the latter having a slight concave bend, and a slightly downward angled portion between 316 and 318. Spring clip 300 further includes a downward angled convex bend of approximately 50 degrees at point 318, a concave bend at 319 that is approximately 120 degrees to concave rounded center portion between 319 and 321. 330 refers to a through-hole in round base 332. At 321 there is a concave upward bend of approximately 120 degrees similar to bend 319. A slight convex bend of approximately 50 degrees at 323 gives way to a straight portion between 323 and 325, and a slight concave upward bend at 325 forms a tab end between 325 and 327.

Figure 4D:
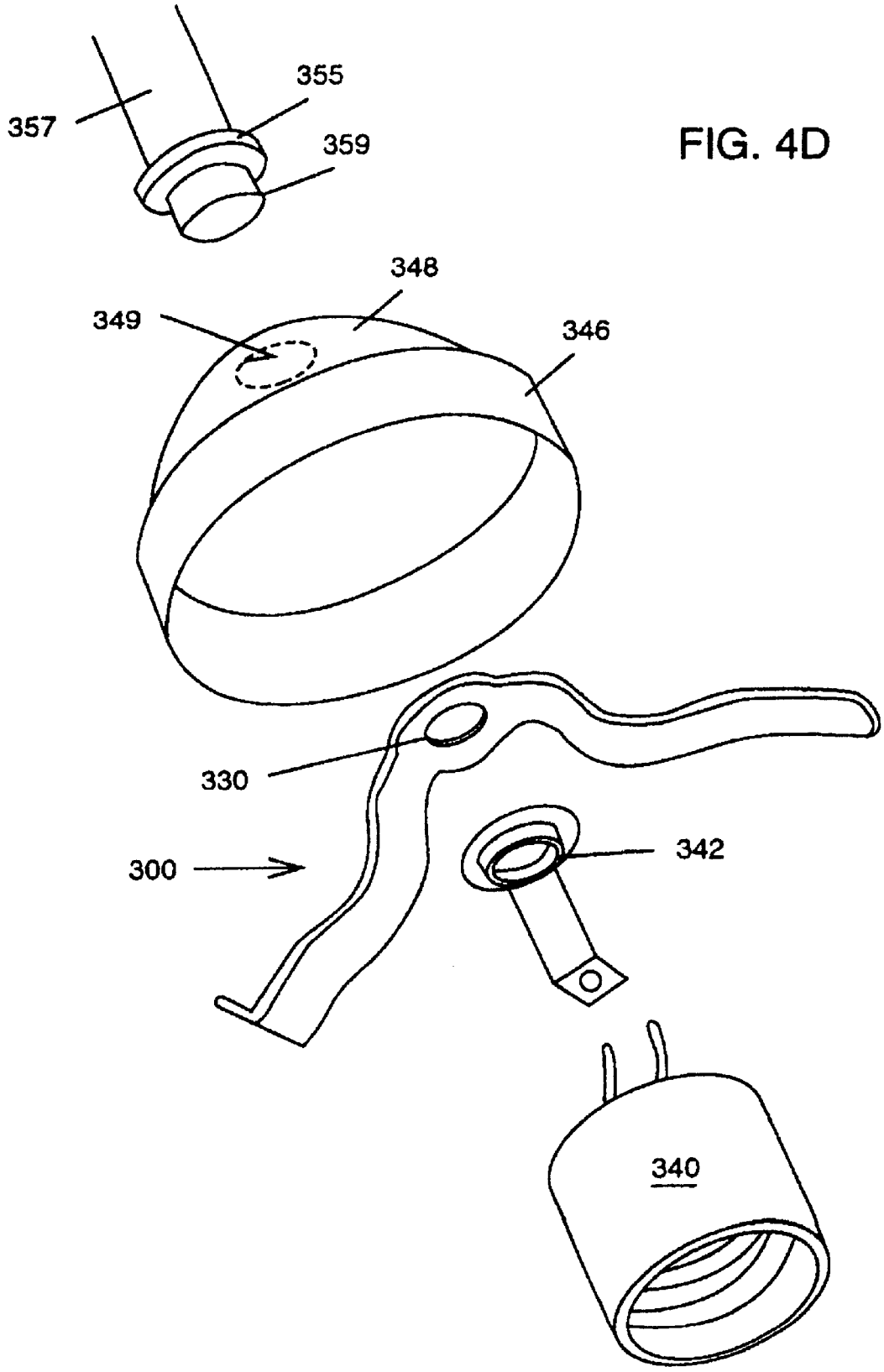
FIG. 4D is an exploded view of the spring clip of FIGS. 4A–4C assembled in a light fixture.

FIG. 4D is an exploded view of the spring clip 300 of FIGS. 4A–4C assembled in a light fixture. Beneath a traditional socket 340 is a socket mounting bracket 342 underwhich the through-hole 330 of the spring clip 300 is positioned. These components are inserted within a cylindrical dome rim 346 of a rounded dome canopy 348. A protrusion end 359 above a raised lip 355 of a stem passes into canopy base opening 349 and into spring clip through-hole 330 to the socket mounting bracket 342 the latter of which is normally fastened to socket 340. The protrusion end 359 is press fit into socket mounting bracket 342, thereby securing the assembly.

Figure 4E:
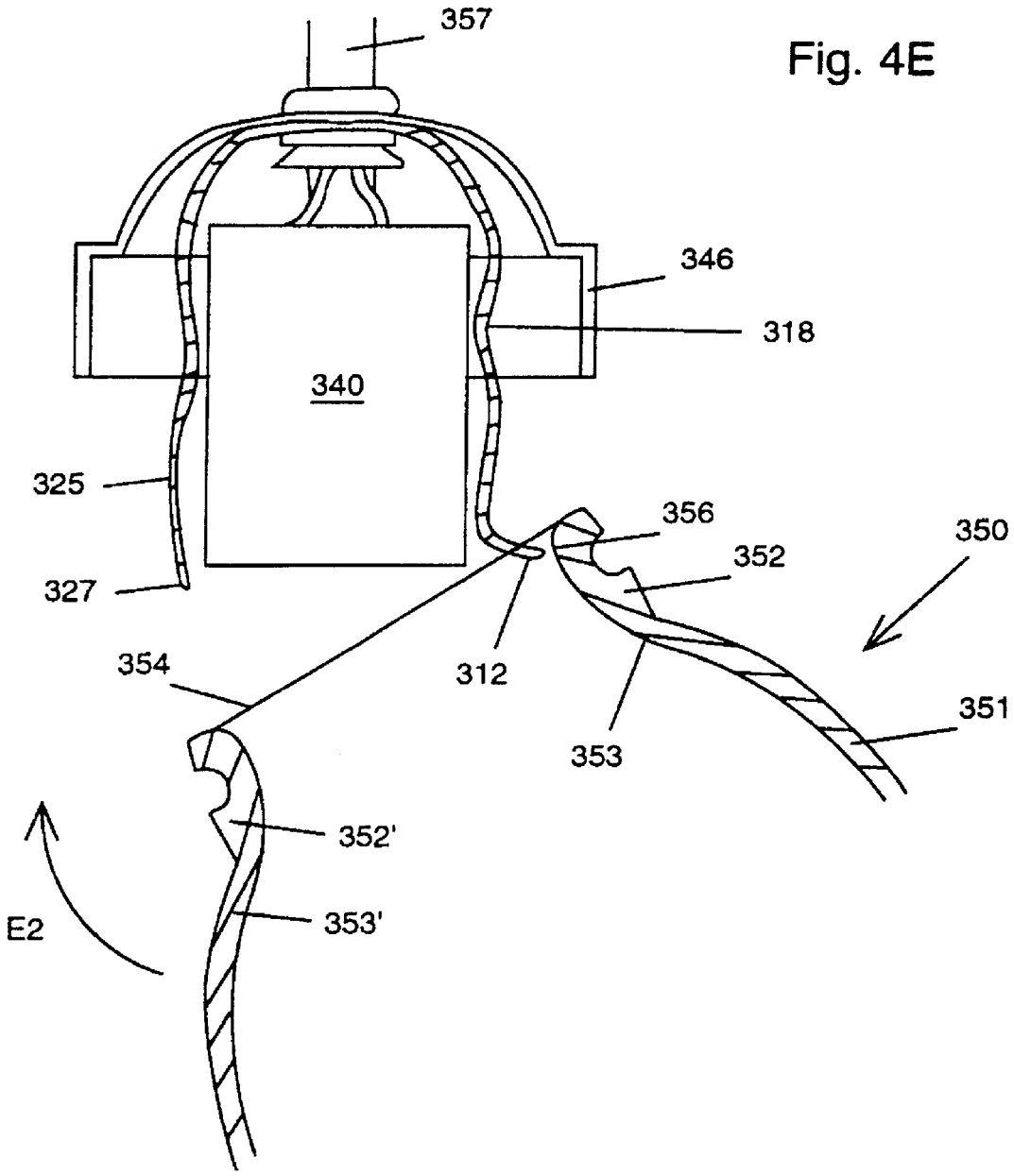
FIG. 4E is a side cross-sectional view of initiating attaching a lamp shade to the assembled spring clip and light socket and fixture of FIG. 4D.

FIG. 4E is a side cross-sectional view of initiating attaching a lamp shade 350 to the assembled spring clip 300 and light socket 340 and fixture 346 of FIG. 4D. Shade 350 generally includes expanded end 351, narrow circular neck 352, 352', an interior rounded interior edge 353, 353' and bottom opening 354. To attach the shade 350, one side 352 is angled downward so that interior edge 356 pushes hook end 312 back to socket 340 so that hook end 312 can fit inside opening 355 first Then opposite shade side 352' is moved down in the direction of arrow E2 to slip over upright inwardly bent clip end 327 by opposite end 352 pivots within ring 346. A user can help assemble the components by manually pushing clip area 325 toward socket 340 with their fingers.

Figure 4F:
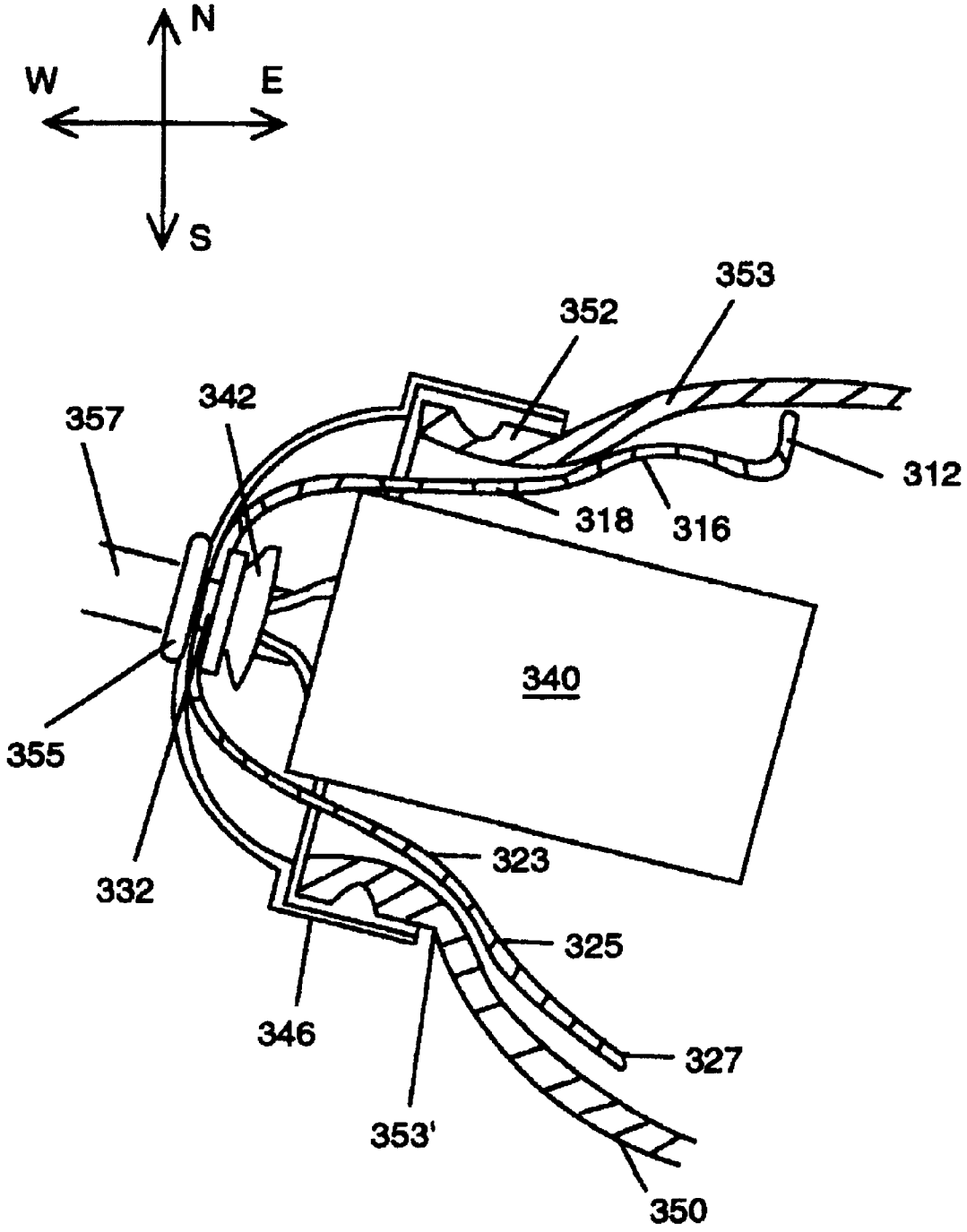
FIG. 4F is a side cross-sectional view of the lamp shade and socket and fixture of FIG. 4D in a fully attached position.

FIG. 4F is a side cross-sectional view of the lamp shade 350 and socket 340 and fixture 346 of FIG. 4D in a fully attached position, with the orientation of North, N shown. Here, portions 316 and 318 of spring clip 300 springably expand and abut against interior rounded edge 353 of shade 350. Also portions 323–325 of spring clip 300 springably expand and abut against opposite interior rounded edge 353'. Removal of the shade 350 is simply done by repeating the assembly steps in reverse order.

Figure 4G:
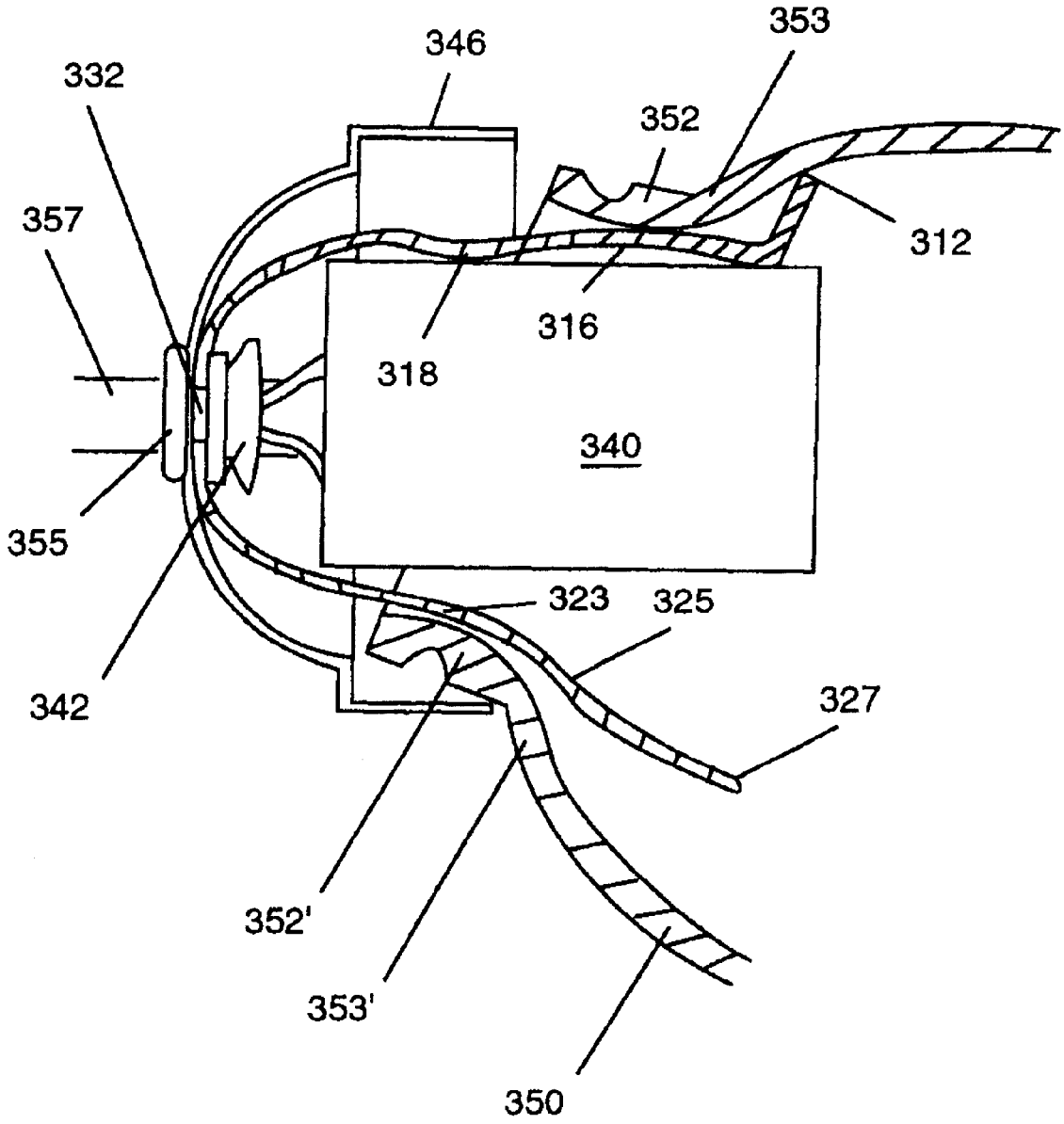
FIG. 4G is a view of the shade drooping from the socket and fixture of FIG. 4F.

FIG. 4G is a view of the shade 350 drooping from the socket 340 and fixture 346 of FIG. 4F. Hook end 312 further acts as a catch to prevent accidental release of the lamp shade 350 especially in situations where the shade 350 is being violently shaken, when someone accidentally knocks the shade 350 during vibrations from attached fan(shown in FIG. 2A, or during an earthquake or the like. As the shade 350 droops down, hook end 312 abuts against interior of shade 350, clip portion 316 abuts against interior of narrow circular neck 352 of shade 350, which prevents the accidental release of the shade 350.

Figure 5B:
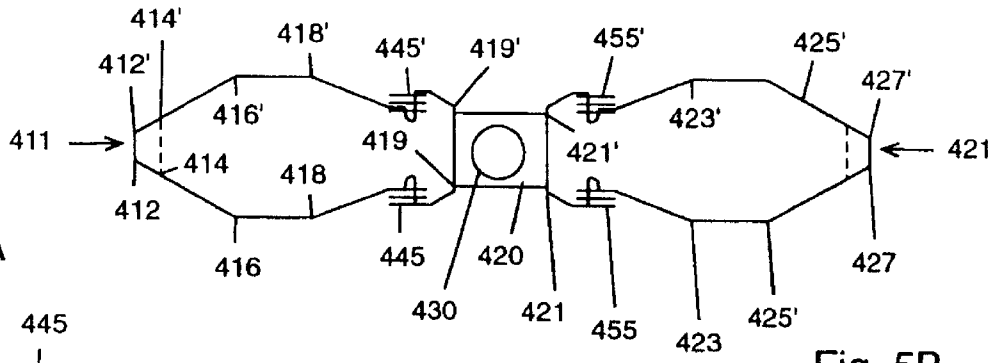
FIG. 5B is a top view of the novel spring clip of FIG. 5A along arrow F.
Figure 5A:
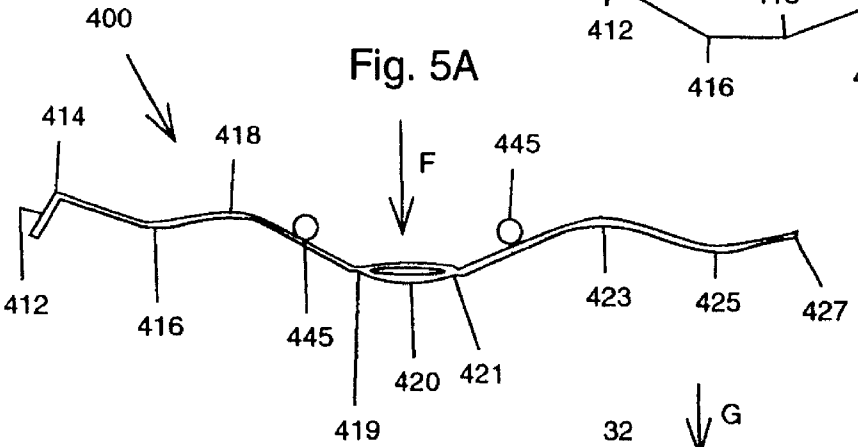
FIG. 5A is a side view of a fourth embodiment of the novel spring clip in an expanded position.

FIG. 5A is a side view of a fourth embodiment 400 of the novel spring clip in an expanded position. FIG. 5B is a top view of the novel spring clip 400 of FIG. 5A along arrow F. Referring to FIGS. 5A–5B, spring clip 400 has left wing portion 411 and right wing portion 421 that each can be formed from wire material such as the metal type materials described previously. Left wing 411 includes downward approximately 90 degree angled hook ends 412,412' connected to bends 414, 414', a straight portion between points 414 and 416, and respectively 414'and 416', the latter having a slight concave bend, a slightly downward angled portion between 416 and 418, and respectively 416' and 418'. A downward angled convex bend of approximately minus 45 degrees at point 418 and respectively 418'. A first spring 445 and 445' is formed between 418 and 419 and respectively 418' and 419'. A flat midportion is between 419 and 421 and respectively 419' and 421' having a through-hole 430 whose use which will be described later. At 421 and 421' there is a concave upward bend of approximately 135 degrees similar to bends 419 and 419'. A second spring 455 and 455' is formed between 421 and 423 and respectively 421 and 423'. A slight convex bend of approximately minus 45 degrees at 423 and 423' gives way to a slightly downward bend to points 425 and respectively 425'. A slight concave upward bend at 425, 425' forms a tab end to 427 and respectively 427'. The rest of embodiment 200 is used similarly to that of the previous embodiment described above.

Figure 5D:
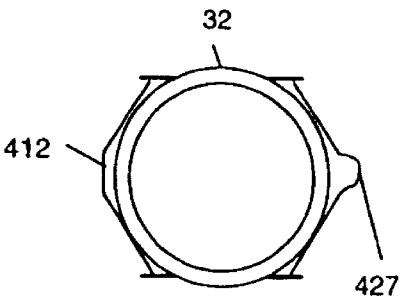
FIG. 5D is a top view of the spring clip and socket of FIG. 5C along arrow G.
Figure 5C:
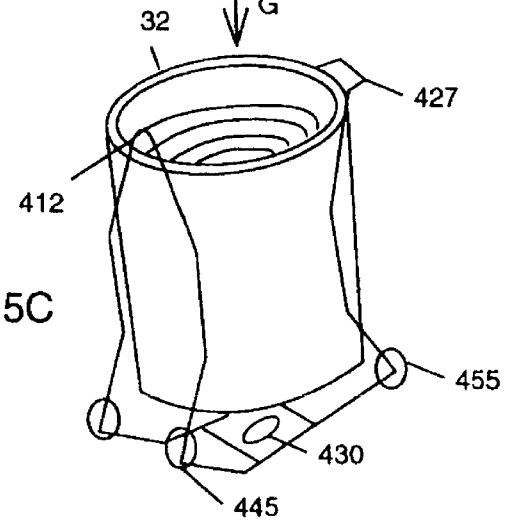
FIG. 5C is a perspective view of the novel spring clip of FIG. 5A in a closed position about a lamp fixture socket.

FIG. 5C is a perspective view of the novel spring clip 400 of FIG. 5A in a folded position with ends 412 and 427 abutting to the sides of a lamp fixture socket 32. FIG. 5D is a top view of the spring clip 400 and socket 32 of FIG. 5C along arrow G. The novel shape allows the wings 411, 421 to surround the socket 32 to allow the neck of the light shade(not shown) to fit over the socket 32 and wings 411 421. Hook end 412 further acts as a catch to prevent accidental release of an attached lamp shade, especially in situations where a shade is being violently shaken, when someone accidentally knocks the shade, during vibrations from attached fan, or during an earthquake or the like.

Figure 6A:
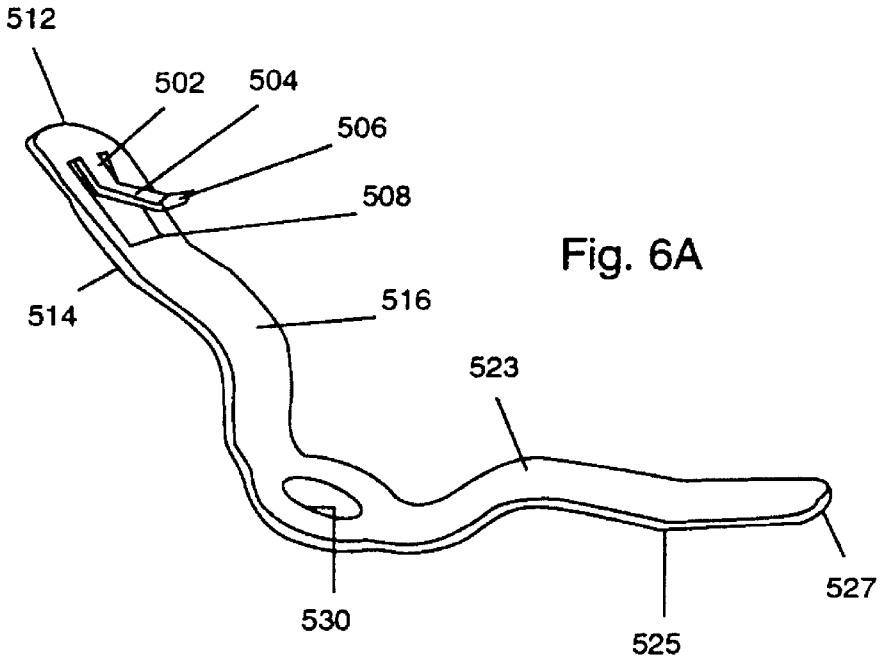
FIG. 6A is a perspective view of a fifth embodiment of the novel spring clip.
Figure 6B:
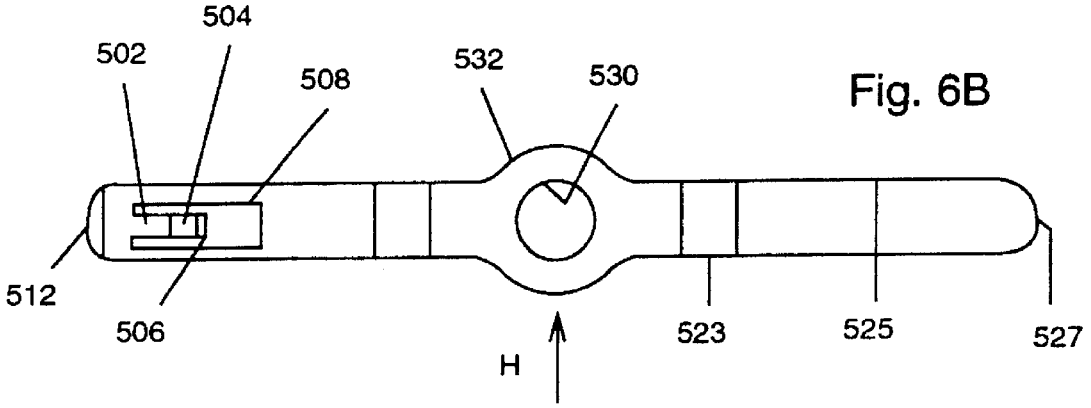
FIG. 6B is a top view of novel spring clip of FIG. 6A.
Figure 6C:
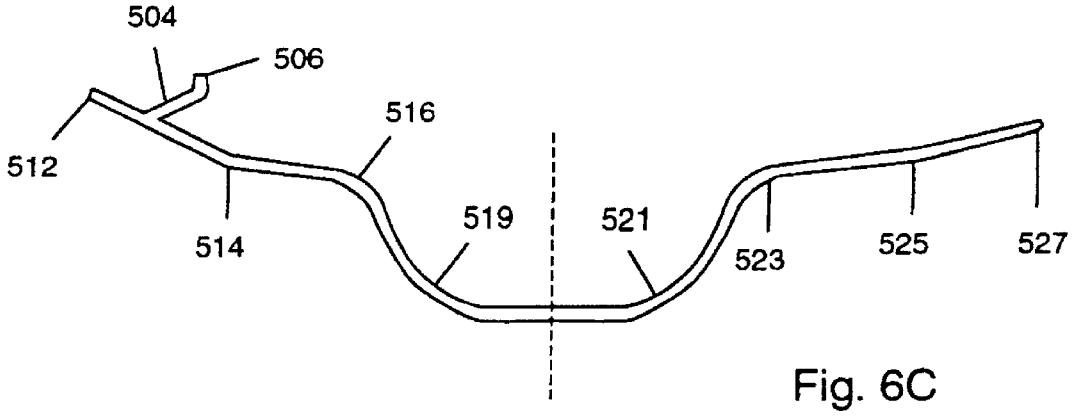
FIG. 6C is a side view of the spring clip of FIG. 6B along arrow H.

FIG. 6A is a perspective view of a fifth embodiment 500 of the novel spring clip. FIG. 6B is a top view of novel spring clip 500 of FIG. 6A. FIG. 6C is a side view of the spring clip 500 of FIG. 6B along arrow R Referring to FIGS. 6A–6C, spring clip 500 includes a left raised planar tab end 512 from point 514, which is approximately 30 degrees from point 514 with a slightly downward angled portion between 514 and 516. Spring clip 500 further includes a downward angled convex bend of approximately 50 degrees at point 516, a concave bend at 519 that is approximately 120 degrees to concave rounded center portion between 519 and 521. 530 refers to a through-hole in round base 532. At 521 there is a concave upward bend of approximately 120 degrees similar to bend 519. A slight convex bend of approximately 50 degrees at 523 gives way to a straight portion between 523 and 525, and a slight concave upward bend at 525 forms a right planar tab end between 525 and 527. Outer ends 512 and 527 have rounded exteriors. A raised barb portion is cut-out of area 508 where a horizontal base 502 has a first raised angle portion 504 at an angle of approximately 45 degrees to it, and a second raised portion 506 forming a tip which is approximately 75 degrees to first portion 504.

Figure 6D:
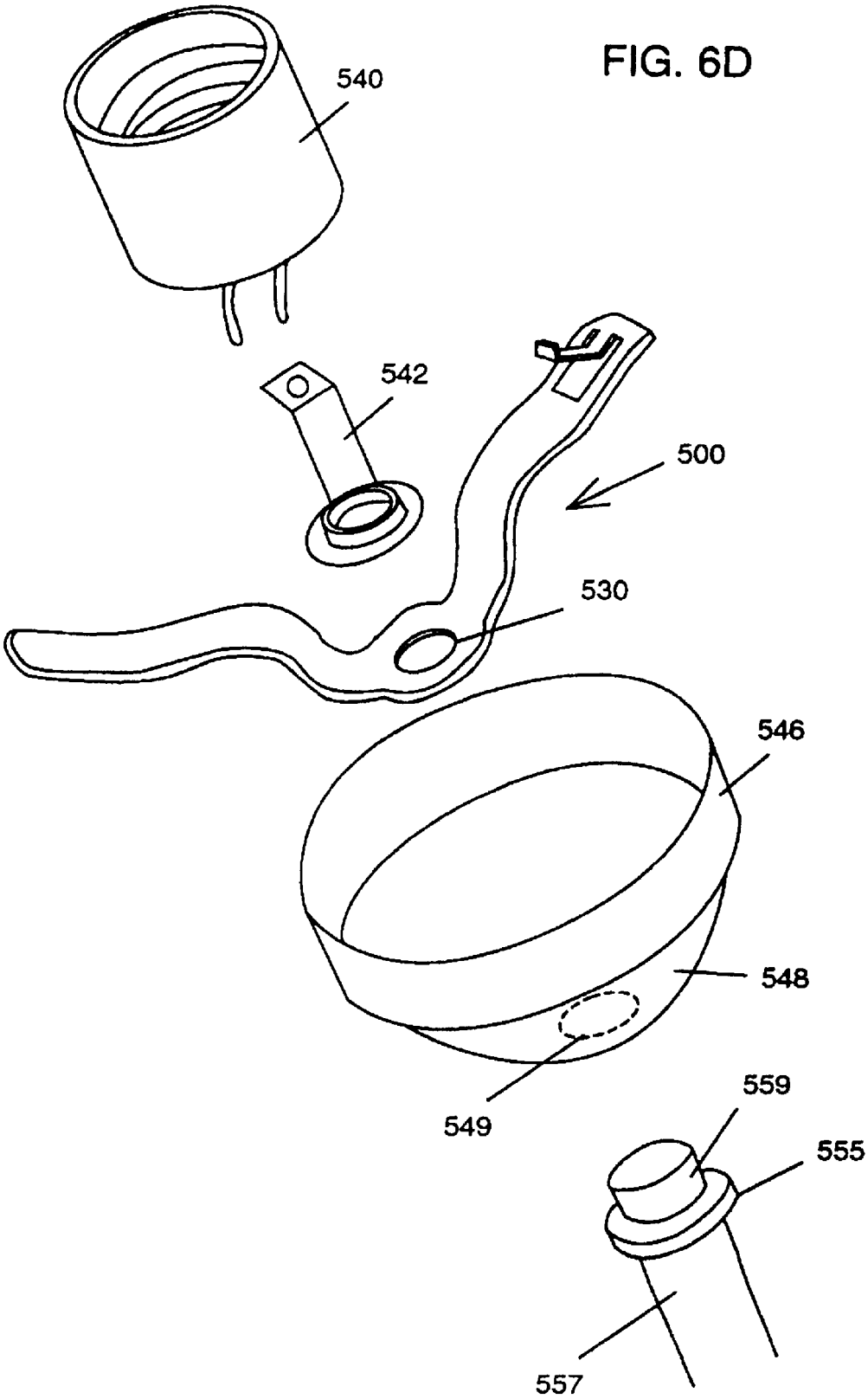
FIG. 6D is an exploded view of the spring clip of FIGS. 5A–5C being positioned beneath a light socket of a light fixture.

FIG. 6D is an exploded view of the spring clip 500 of FIGS. 5A–5C being positioned beneath a light socket 540 of a light fixture. Beneath a traditional socket 540 is a socket mounting bracket 542 underwhich the through-hole 530 of the spring clip 500 is positioned. These components are inserted within a cylindrical dome rim 546 of a rounded dome canopy 548. A protrusion end 559 above a raised lip 555 of a stem passes into canopy base opening 549 and into spring clip through-hole 530 to socket mounting bracket 542 the later of which is normally fastened to socket 540. The protusion end 559 is press fit into socket mounting bracket 542, thereby securing the assembly.

Figure 6E:
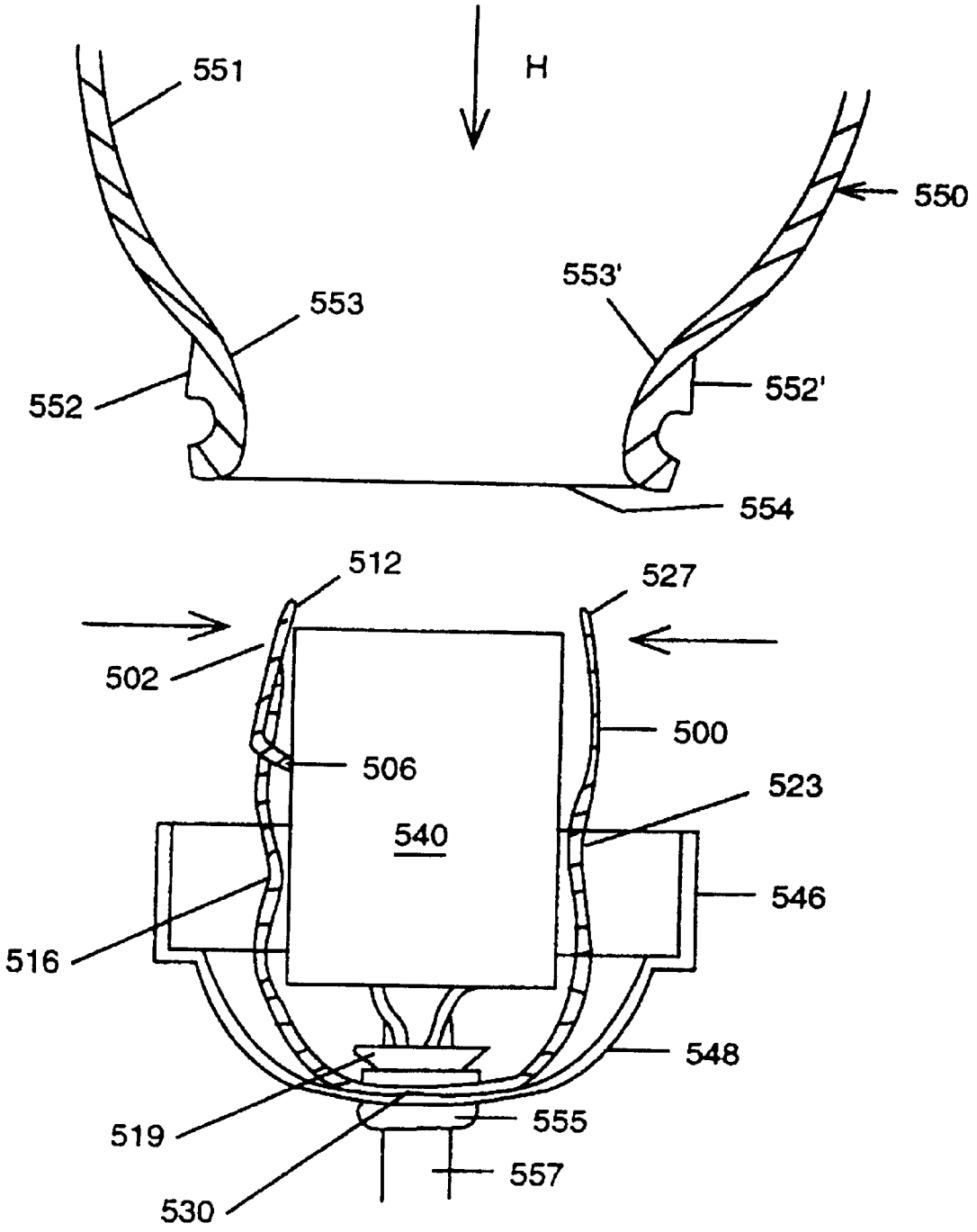
FIG. 6E is a side cross-sectional view of initiating attaching a lamp shade to the assembled spring clip and light socket and fixture of FIG. 6D.

FIG. 6E is a side cross-sectional view of initiating attaching a lamp shade 550 to the assembled spring clip 500 and light socket 540 and fixture 557 of FIG. 6D. Shade 550 generally includes expanded end 551, narrow circular neck 552, 552', an interior rounded interior edge 553, 553' and bottom opening 554. To attach the shade 550, bottom opening 554 is positioned so that ends 512, 527 of spring clip 500 can be fitted inside and shade 550 is moved downward in the direction of arrow H. A user can help assemble the components by manually pushing clip areas 502 and 530 in toward socket 540 with their fingers.

Figure 6F:
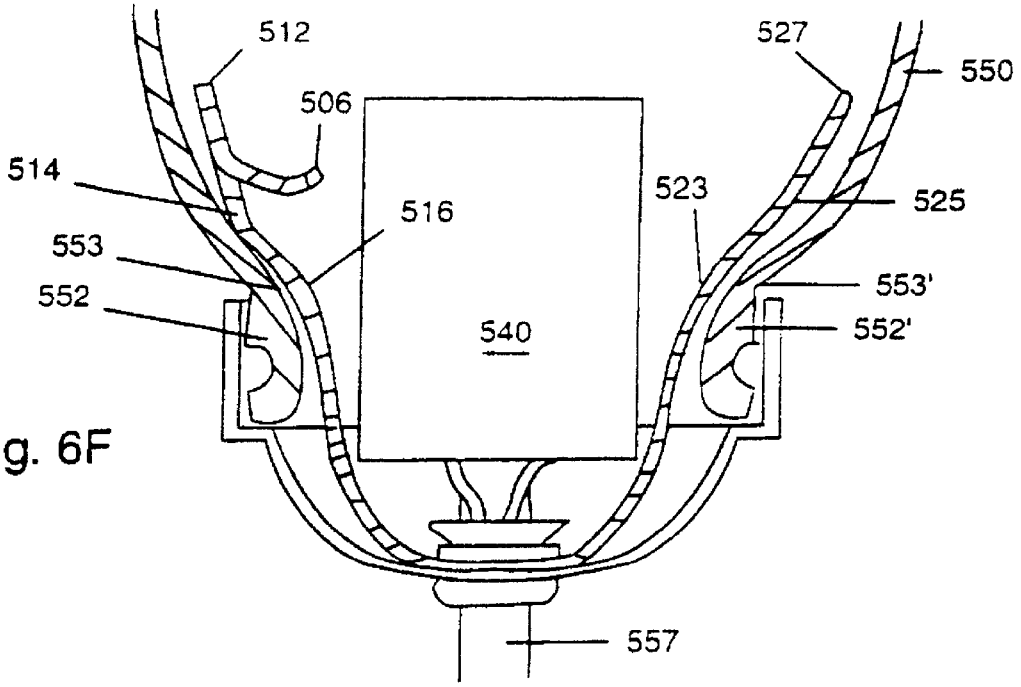
FIG. 6F is a side cross-sectional view of the lamp shade and socket and fixture of FIG. 6D in a fully attached position.

FIG. 6F is a side cross-sectional view of the lamp shade 550 and socket 540 and fixture 527 of FIG. 6D in a fully attached position. Here, portions between 514 and 516 of spring clip 500 springably expand and abut against interior rounded edge 553 of shade 550. Also portions between 523 and 525 of spring clip 500 springably expand and abut against opposite interior rounded edge 553' of shade 550. In this position tip 506 is extended toward socket 540.

Figure 6G:
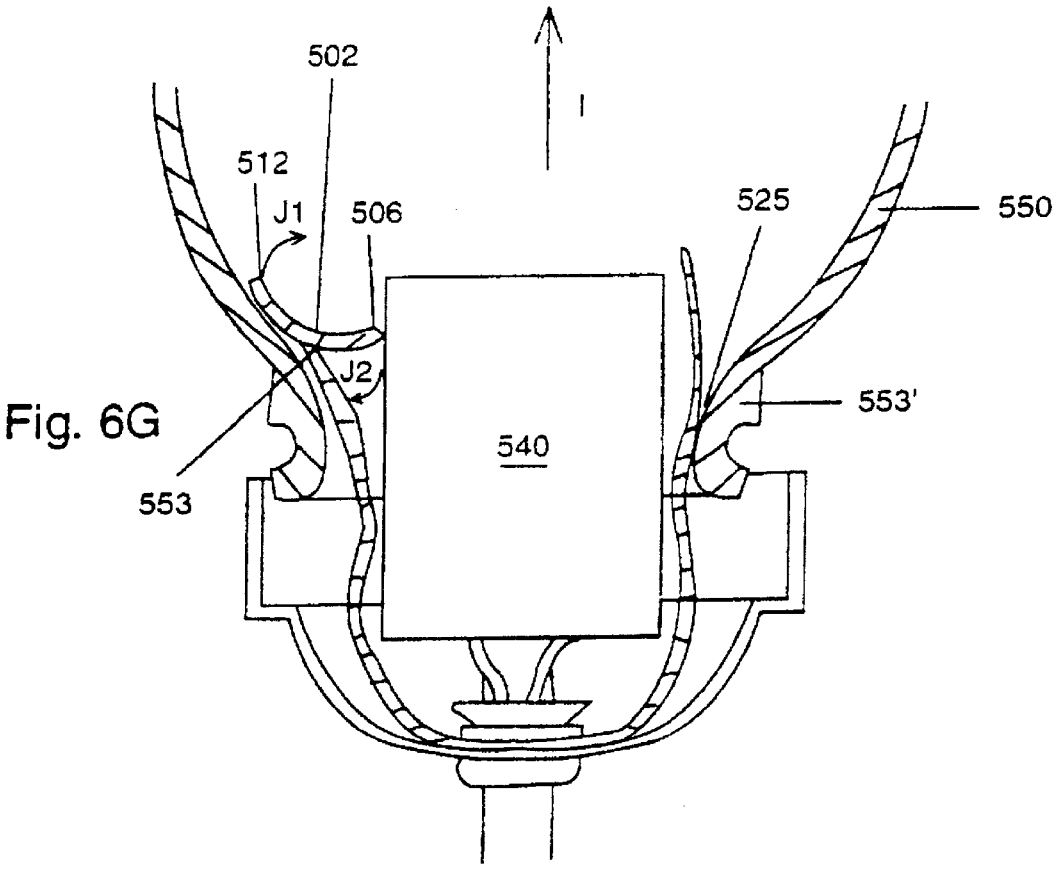
FIG. 6G is a side cross-sectional view of the shade being accidentally removed from the socket and fixture of FIG. 6F.

FIG. 6G is a side cross-sectional view of pulling the shade 550 off the socket 540 and fixture 557 of FIG. 6F in the direction of arrow I. Here it can be seen that barb tip 506 abuts against socket 540 and clip end 512 and barb base 502 abut against interior rounded edge 553 of shade 550. The position of the barb tip 506 and clip portions 512 and 502 act to prevent release of the lamp shade 550 especially in situations where the shade 550 is being violently shaken, when someone accidentally knocks the shade 550, during vibrations from attached fans, or during an earthquake or the like. The shade 550 can be ultimately detached by manually pushing tab end 512 in toward socket 540 in the direction of arrow J1. This simultaneously causes barb end 506 to move in the direction of arrow J2 allowing shade 550 to be removed from fixture 557 in the direction of arrow I.

Figure 7A:
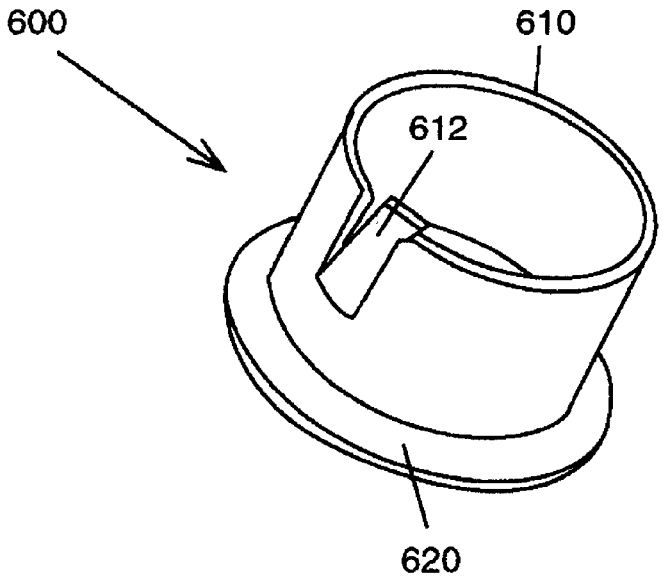
FIG. 7A is a perspective view of a sixth preferred embodiment of a safety sleeve shield.
Figure 7B:
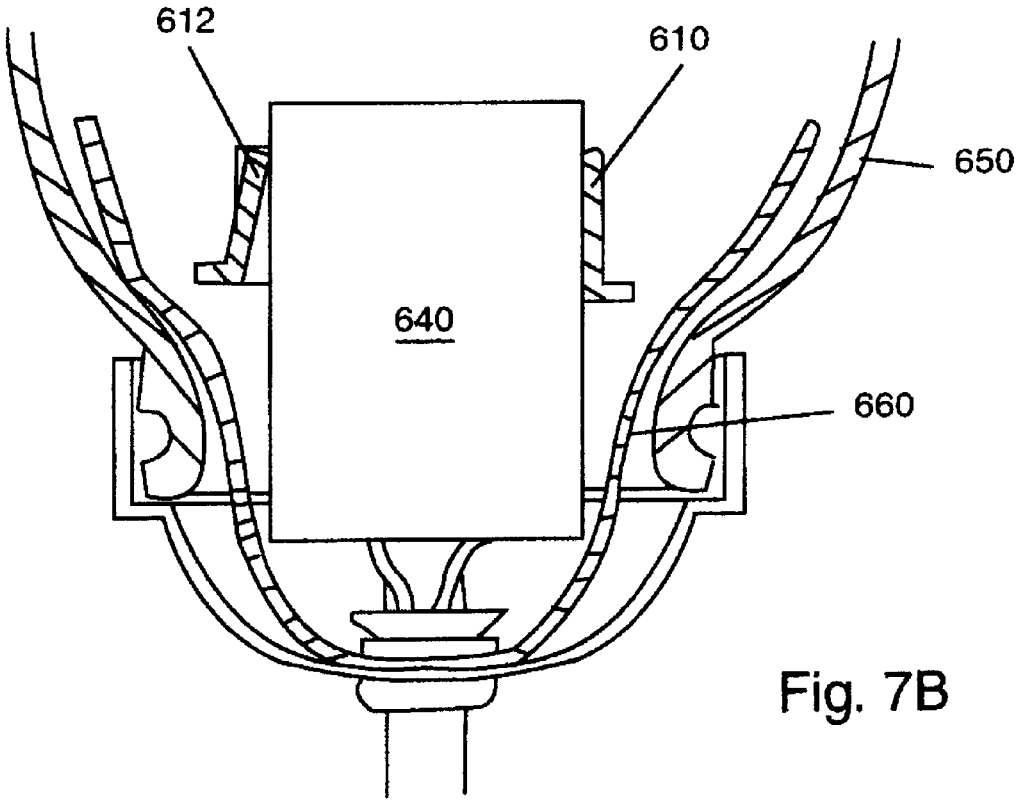
FIG. 7B is a side view of the safety sleeve shield of FIG. 7A with an assembled novel spring clip and fixture of the preceding embodiments.

FIG. 7A is a perspective view of a sixth preferred embodiment 600 of a safety sleeve shield. Shield 600 which can be formed from steel, aluminum and the like, and includes a cylindrical top 610 having at least one bent in side tab 612. Attached to cylindrical top 610 is a perpendicular base ledge 620. FIG. 7B is a side view of the safety sleeve shield 600 of FIG. 7A pushed down over a socket 640 which can correspond to similar sockets shown in the preceding figures. The shield 600 can further be used with a novel spring clip 660 and lamp shade 650 also similar to those described previously. Shield 600 acts to prevent release of the lamp shade 650 especially in situations where the shade 650 is being violently shaken, when someone accidentally knocks the shade 650, during vibrations from attached fans, or during an earthquake or the like.

While the embodiments described above refer to a lamp shade, various shapes of lamp shades such as but not limited to global shaped and funnel shape shades can be used.

Although the preferred embodiments are described for use with light fixtures on ceiling fans, the invention can be applied to any light fixtures where expandable fragile shades such as globes and funnels need to be fastened to fixtures having sockets.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A spring clip connector for attaching a shade to a light fixture comprising in combination:

a light fixture having a socket fixably attached to a canopy;

a shade; and an expandable longitudinal clip having a portion located beneath and adjacent to a bottom edge of the socket and an additional portion for expanding against an interior portion of the shade wherein the clip secures the shade to the fixture while the socket is attached to the canopy.

2. The spring clip connector of claim 1, wherein the expandable longitudinal clip includes:

a single longitudinal clip.

3. The spring clip connector of claim 2, wherein the single longitudinal clip includes:

a first bend between a midportion of the clip and a first end, and a second bend between the midportion of the clip and a second end that is opposite to the first end.

4. The spring clip connector of claim 3, wherein the first bend and the second bend each include: a concave bend.

5. The spring clip connector of claim 2, wherein the single longitudinal clip includes:

a solid mnidportion without any through-hole, so that the midportion can be positioned beneath and adjacent to a bottom edge of the socket.

6. A method of installing a connector and attaching a shade to a light fixture, comprising the steps of:

pre-positioning a portion of an expandable longitudinal clip beneath an edge of a socket, the socket being attached to a canopy;

maneuvering a mouth of a shade over at least one end of the expandable longitudinal clip, while the socket is attached to the canopy; and expanding the at least one end of the expandable longitudinal clip within the shade so that the shade is secured to the light fixture without having to separate the canopy from the socket.

7. The method of claim 6, wherein the pre-positioning step further includes:

pre-positioning the expandable longitudinal clip beneath and adjacent to a bottom edge of the socket.

8. A spring slip connector for attaching a shade to a light fixture having a socket, comprising in combination:

a light fixture having a socket fixably attached to a canopy;

a shade; and an expandable longitudinal clip having a portion located underneath and adjacent to an outer edge of the socket, and at least one end for expanding against an interior portion of the shade, wherein the clip secures the shade to the fixture while the socket is attached to the canopy.

* * * * *